US010712001B2

(12) United States Patent
Masumoto et al.

(10) Patent No.: US 10,712,001 B2
(45) Date of Patent: Jul. 14, 2020

(54) COMBUSTION DEVICE

(71) Applicant: NORITZ CORPORATION, Hyogo (JP)

(72) Inventors: Kentaro Masumoto, Kobe (JP); Hiroaki Tanaka, Kobe (JP); Tetsunori Kuriyama, Kobe (JP); Keiichi Mandai, Kobe (JP); Makoto Kusakabe, Kobe (JP); Isao Sato, Kobe (JP); Tomofumi Kinugasa, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 46 days.

(21) Appl. No.: 16/134,466

(22) Filed: Sep. 18, 2018

(65) Prior Publication Data

US 2019/0093888 A1 Mar. 28, 2019

(30) Foreign Application Priority Data

Sep. 26, 2017 (JP) ..... 2017-185408

(51) Int. Cl.
*F23N 5/24* (2006.01)
*F23J 13/04* (2006.01)
(Continued)

(52) U.S. Cl.
CPC ..... *F23N 5/245* (2013.01); *F23J 13/04* (2013.01); *F23J 2211/20* (2013.01);
(Continued)

(58) Field of Classification Search
CPC ..... F23L 17/00; F23N 3/08; F23N 5/24; F23J 13/04
(Continued)

(56) References Cited

U.S. PATENT DOCUMENTS 4,005,820 A * 2/1977 Cress ..... F23N 1/065 236/1 G
4,333,746 A * 6/1982 Southam ..... B01D 53/8609 422/168
(Continued)

FOREIGN PATENT DOCUMENTS

JP 10169904 A * 6/1998 ..... F23N 3/08
JP 2013029255 A * 2/2013 ..... F23N 5/24
(Continued)

*Primary Examiner* — Edelmira Bosques
*Assistant Examiner* — Nikhil P Mashruwala
(74) *Attorney, Agent, or Firm* — Studebaker & Brackett PC

(57) ABSTRACT

The combustion device includes: a burner; an igniter; a fuel supply unit that supplies fuel to the burner; a blower fan that supplies air for combustion; an exhaust port that discharges combustion exhaust; a device control unit that, before ignition of fuel supplied to the burner by operation of the igniter, performs air purge of the burner at a predetermined air blowing amount by driving the blower fan; and a setting means that is set when a check valve for preventing back flow of exhaust is connected to the exhaust port. When the setting means is set to indicate that the check valve is connected, the device control unit controls the operation of the blower fan so that slow-start air purge is performed in which the time interval from the start of air purge until the predetermined air blowing amount is reached becomes longer, than in the case in which no such check valve is connected.

5 Claims, 4 Drawing Sheets

(51) Int. Cl.
*F23N 3/08* (2006.01)
*F23L 17/00* (2006.01)

(52) U.S. Cl.
CPC ..... *F23J 2213/70* (2013.01); *F23L 17/00* (2013.01); *F23N 3/08* (2013.01)

(58) Field of Classification Search
USPC ..... 431/20
See application file for complete search history.

(56) References Cited

U.S. PATENT DOCUMENTS 4,466,815 A * 8/1984 Southam ..... B03C 3/013 422/117
4,488,537 A * 12/1984 Laurent ..... F23C 3/004 126/376.1
4,634,369 A * 1/1987 McGill ..... F23G 5/50 431/202
7,008,217 B2 * 3/2006 Jacobberger ..... F23N 5/206 431/18
8,001,773 B2 * 8/2011 Winter ..... F01N 3/025 60/284
8,359,834 B2 * 1/2013 Gaudin ..... F01N 3/025 60/286
10,343,195 B2 * 7/2019 Daniel ..... F23G 5/50

FOREIGN PATENT DOCUMENTS

JP 20133242096 A * 12/2013 ..... F23N 5/20
JP 5852458 B2 2/2016

* cited by examiner

COMBUSTION DEVICE

BACKGROUND OF THE INVENTION

The present invention relates to a combustion device, and in particular relates to a combustion device in which a check valve is connected to an exhaust port, in order for the exhaust port to be connected to an exhaust duct that is utilized in common by a plurality of combustion devices.

In the prior art, a compound combustion device is per se known in which a plurality of combustion devices each of which comprises individual combustion unit and individual blower fan are installed in a facility in parallel, and the exhaust ports of these combustion devices are all connected to a common exhaust duct. With such a compound combustion device, operation is performed to discharge the combustion exhaust from each of the combustion devices to the exterior of the facility via the common exhaust duct by rotating the respective blower fan, while adjusting the number of operating combustion devices according to the load.

However, if only some of the combustion devices among the plurality of combustion devices are being operated to perform combustion, then, since the blower fans of the combustion devices that are in the non-combusting state are not being rotated, accordingly the combustion exhaust may flow in reverse from the common exhaust duct into the exhaust ports of one or more of the combustion devices that are in the non-combusting state, and there is a fear that this reverse flow may penetrate into the interior of the facility.

Accordingly, as shown in the Prior Art Document, normally, check valves are connected so that no reverse flows of exhaust back from the common exhaust duct into the exhaust ports of the combustion devices can occur.

Since the check valve disclosed in the Prior Art Document incorporates both a large sized first valve and also a compact second valve which is provided in the center portion of this first valve, accordingly when the amount of combustion exhaust is small only the second valve is opened, and when the amount of combustion exhaust increases the first valve is also opened.

As shown in FIG. 2 which relates to an embodiment of the present invention, the check valve that the present applicant employs comprises a circular plate shaped valve plate 26, four guide rods 27 that guide this valve plate 26 so that it can move upward and downward freely, and a horizontal stopper 28 that is fixed to the upper end portions of these four guide rods 27. When the rotation of the blower fan starts during air purge directly before combustion operation, the valve plate 26 rises and exhaust is discharged.

Japanese Patent 5,852,458 is cited as the Prior Art Document.

When a check valve as shown in FIG. 2 is employed, during air purge (i.e. pre-purging) when the combustion device is ignited and when the blower fan is rotationally driven at a high acceleration in order to reach its predetermined rated rotational speed in a short time interval of the order of one second, the valve plate 26 of the above described check valve rises sharply and collides with the stopper 28, so that there is the problem that an abrupt and unpleasant clattering noise is generated.

The object of the present invention is to provide a combustion device, with which it is arranged for no abrupt noise to be generated by a check valve of the above type during such air purge.

SUMMARY OF THE INVENTION

The present invention presents a combustion device comprising a combustion unit, an ignition means, a fuel supply unit for supplying fuel to the combustion unit, a blower unit for supplying air for combustion, an exhaust port that discharges combustion exhaust, a control means that, before ignition of fuel supplied to the combustion unit by operation of the ignition means, performs air purge of the combustion unit at a predetermined air blowing amount by driving the blower unit; and a setting means for setting to indicate that a check valve for preventing back flow of exhaust is connected to the exhaust port; wherein, when the setting means is set to indicate that the check valve is connected, the control means controls an operation of the blower unit so that slow-start air purge is performed in which a time interval from a start of air purge until the predetermined air blowing amount is reached becomes longer, than in a case in which no such check valve is connected.

According to the constitution described above, when a check valve is connected to the exhaust port and the connection setting for the check valve is established by the setting means, the operation of the blower unit is controlled so that slow-start air purge is performed in which the time interval from the start of air purge until the predetermined air blowing amount is reached becomes longer, than in the case in which no such check valve is connected; and accordingly the rate of increase of the amount of air blown from the blower unit becomes lower, so that it is possible to suppress rapid opening of the check valve, and it is possible reliably to prevent the generation of discordant noise due to collision between the valve element of the check valve and its stopper.

In a preferable first aspect of the present invention, in the slow-start air purge, the operation of the blower unit is controlled so that, after having waited for a predetermined time interval at an intermediate air blowing amount at which the check valve is partly open, the air blowing amount is increased until it reaches the predetermined air blowing amount.

According to the constitution described above, since the control means waits for the predetermined time interval at the intermediate air blowing amount at which the check valve is partly open, accordingly it is possible to suppress rapid rise of the valve element of the check valve, and it is possible reliably to prevent collision between the valve element and the stopper.

And, in a preferable second aspect of the present invention, the exhaust ports of a plurality of combustion devices are connected to a common exhaust duct, and the check valve is disposed between the common exhaust duct and the exhaust port.

According to the constitution described above, when the combustion device is in the combusting state, it is possible for combustion exhaust to be discharged via the check valve to the common exhaust duct; and, when the combustion device is in the non-combusting state, it is possible to prevent back flow of combustion exhaust from the common exhaust duct to the combustion device with the check valve.

Moreover, in a preferable third aspect of the present invention, if the combustion operation of the combustion device is newly started while another combustion device is performing combustion, then the slow-start air purge is not performed even if the setting means is set to indicate that such a check valve is connected.

According to the constitution described above, since during combustion operation of another combustion device the internal pressure within the common exhaust duct is high because combustion exhaust is flowing in it, accordingly the valve element of the check valve will not rise abruptly even if air purge is started from the not-yet-burning state, so that there is no danger of the collision noise becoming high.

DETAILED DESCRIPTION

Figure 1:
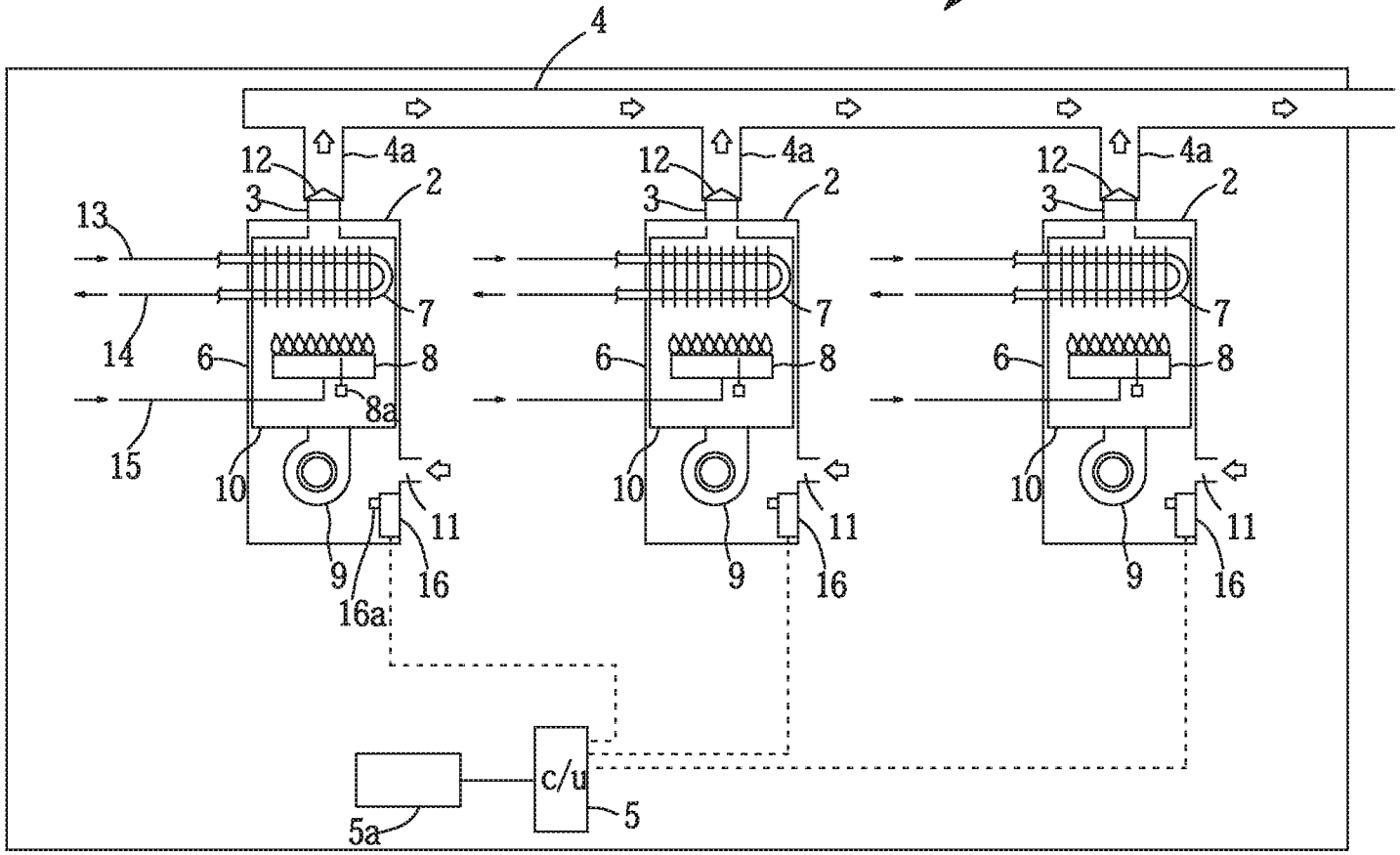
FIG. 1 is a structural diagram showing a compound combustion system according to an embodiment of the present invention.

First, a compound combustion system in which a plurality of combustion devices that are used for supplying hot water are installed will be explained with reference to FIG. 1. This compound combustion system 1 comprises three combustion devices 2 that are arranged in parallel, a common exhaust duct 4 that is connected in parallel to exhaust ports 3 of these three combustion devices 2, and a main control unit 5.

Each of the combustion devices 2 is a gas-burning type combustion device and has a outer casing 6, and a box shaped inner casing 10 disposed in an upper portion and an intermediate portion of the interior of the outer casing 6, a heat exchanger 7 is disposed in an upper portion of the interior of the inner casing 10, a burner 8 (i.e. a combustion unit) and an igniter 8*a* (i.e. an ignition means) are disposed in a lower portion of the inner casing 10, and a blower fan 9 is disposed in the interior of the outer casing 6 below the inner casing 10 so that an air blowing port of the blower fan 9 opens within the inner casing 10.

An air introduction port 11 is formed in the lower portion of the outer casing 6 and an exhaust port 3 is formed at the upper end of the outer casing 6, with the exhaust port 3 being connected to a branch duct 4*a* of the common exhaust duct 4 and with a check valve 12 being connected to the exhaust port 3. No such check valve 12 is installed if only a single combustion device 2 is used. Moreover, an exhaust cylinder portion of the upper wall portion of the inner casing 10 is connected to the exhaust port 3.

Fresh water supplied to the heat exchanger 7 from a water supply pipe 13 is heated up to become hot water, and is fed via a hot water outlet pipe 14 into a hot water storage tank (not shown in the figures) and is stored therein as hot water. A water quantity sensor (not shown in the figures) and a water temperature thermistor (also not shown) are installed to the water supply pipe 13. Moreover, fuel gas is supplied via a gas supply conduit 15 to the burner 8, and a proportional electromagnetic gas control valve (not shown in the figures) is installed to this gas supply conduit 17.

An electric motor (not shown in the figures) is coaxially linked to the blower fan 9 and drives that blower fan 9 to supply air for combustion, and a rotational speed sensor (also not shown) is provided for detecting the rotational speed of the blower fan 9.

A device control unit 16 (i.e. a control means) that controls devices of various types provided to the combustion device 2 is provided in the lower portion of the interior of the outer casing 6, and this device control unit 16 is electrically connected to sensors of various types, to valves of various types, and to actuators of various types that are provided to the combustion device 2. This device control unit 16 comprises a microcomputer that includes a CPU, ROM, RAM and so on, and this microcomputer stores various control programs for controlling the devices of various types provided to the combustion device 2, including a control program for combustion starting control shown in FIG. 5.

Furthermore, a dip switch 16*a* (this is equivalent to the "setting means") is provided to the device control unit 16 for setting to indicate that a check valve 12 is connected: and this dip switch 16*a* is set to ON when the combustion device 2 is connected to a common exhaust duct 4 and a check valve 12 is connected to the exhaust port 3. On the other hand, the dip switch 16*a* is left at OFF if the combustion device 2 is not installed to a compound combustion system 1, but is being used as a single combustion device.

The three device control units 16 of the three combustion devices 2 are connected to the main control unit 5, and are adapted to be capable of transmitting required signals of various types with the main control unit 5. Furthermore, a remote control device 5*a* is connected to the main control unit 5.

Figure 2:
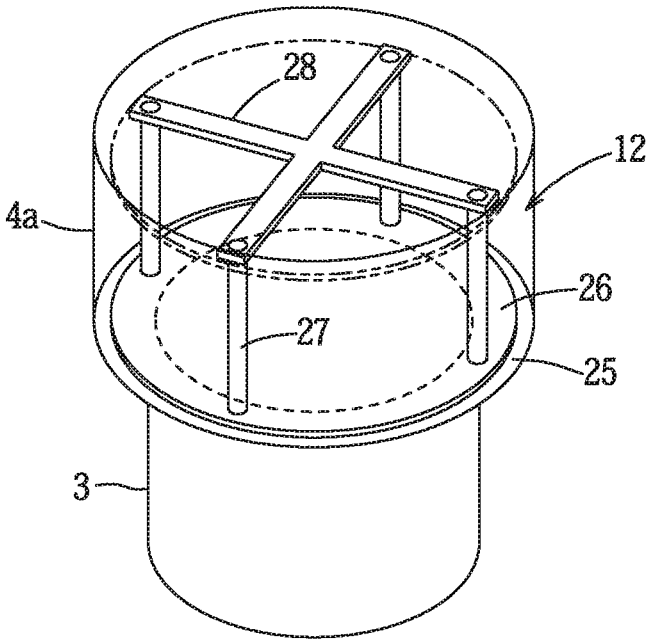
FIG. 2 is a perspective view of a check valve.

Next, the check valve 12 will be explained with reference to FIG. 2.

The lower end of the branch duct 4*a* of the common exhaust duct 4 is connected via a flange portion 25 to the upper end of the exhaust port 3, and the check valve 12 is installed in the interior of the lower end portion of the branch duct 4*a*.

This check valve 12 comprises a valve plate 26 that is formed as a circular disk, four guide rods 27 that stand up from the flange portion 25 and pass through the valve plate 26 and guide the valve plate 26 so that it can move upward and downward freely, and a cross shaped stopper 28 that is fixed to the upper ends of these four guide rods 27; and, when the blower fan 9 is driven, the valve plate 26 rises according to the magnitude of the blown air flow and the valve goes into its open state. On the other hand, if the combustion exhaust attempts to flow backward into the branch duct 4*a*, then the valve plate 26 drops and the check valve 12 goes into the closed state.

Next, an air purge for driving the blower fan 9 at a predetermined air blowing rate before ignition of the fuel supplied to the burner 8 and for thereby purging the air in the burner 8 and in its vicinity will be explained.

When the DIP switch 16*a* is set to its ON position so as to indicate the device control unit 16 that a check valve 12 is fitted, then the device control unit 16 controls the operation of the blower fan 9 so that a slow-start air purge is performed, in which the time interval from the time point when air purge starts to the time point when a predetermined air blowing amount is reached, becomes longer than in the case when no check valve 12 is fitted.

Figure 3:
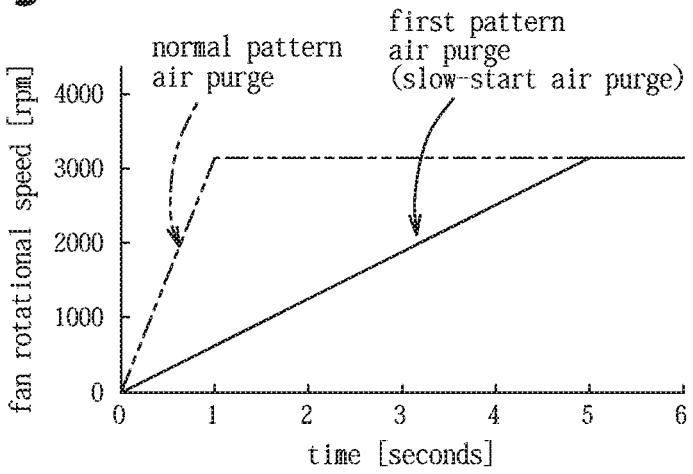
FIG. 3 is a figure showing a first drive characteristic of a blower fan.

FIG. 3 shows the air purge according to a normal pattern and an air purge according to a first pattern (i.e. according to slow-start air purge). In the air purge according to the normal pattern, the operation of the electric motor for driving the fan 9 is controlled so that the fan rotational speed is sharply elevated to a predetermined rotational speed (in other words, to a predetermined air blowing amount) in about one second.

By contrast, in the air purge according to the first pattern, the operation of the electric motor for driving the fan 9 is controlled according to a slow-start air purge in which the fan rotational speed is elevated to the predetermined rotational speed (in other words, to the predetermined air blowing amount) over, for example, about five seconds. Since, in this air purge according to the first pattern, the fan rotational speed is raised at low speed (i.e. at low rotational acceleration), accordingly the speed at which the valve plate 26 rises also becomes low, so that the colliding noise when the valve plate 26 collides with the stopper 28 is reduced.

Figure 4:
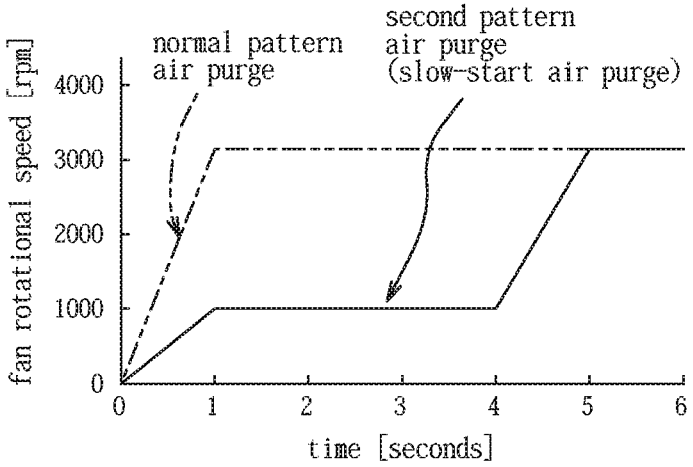
FIG. 4 is a figure showing a second drive characteristic of the blower fan.

Moreover, FIG. 4 shows the air purge according to the normal pattern and an air purge according to a second pattern (i.e. according to another type of slow-start air purge). In the air purge according to the second pattern, first the fan rotational speed is elevated to about ⅓ of the predetermined rotational speed so that the valve plate 26 of the check valve 12 opens and allows a certain air blowing amount to pass, and, after waiting for a predetermined waiting interval (for example, three seconds) at this air blowing amount, the fan rotational speed is then sharply elevated to the predetermined rotational speed.

Even though the fan rotational speed is sharply elevated to the predetermined rotational speed after this waiting interval, there is no fear that the valve plate 26 will rise abruptly because combustion exhaust is already present in the branch duct 4*a*, and accordingly the colliding noise when the valve plate 26 collides with the stopper 28 is reduced.

Figure 5:
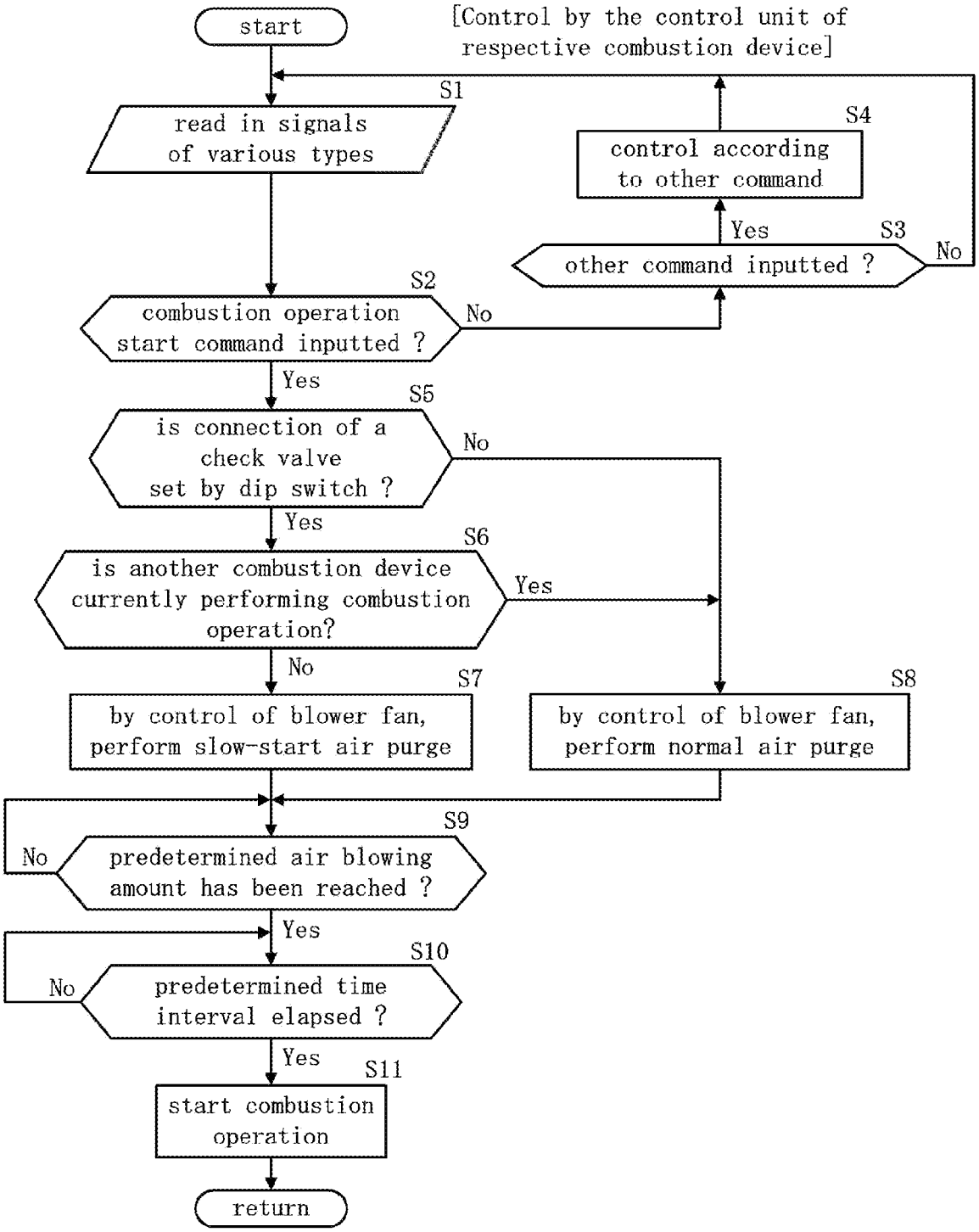
FIG. 5 is a flow chart for combustion starting control for starting combustion by a combustion device.

Next, combustion starting control for starting combustion by the combustion device 2 will be explained with reference to the flow chart of FIG. 5. This combusting starting control is a control procedure that is performed by the device control unit 16 of each of the combustion devices 2. Additionally, in the flow chart, S1 (i=1, 2, . . . ) shows respective step.

Initially, signals of various type are read in (S1), and next it is determined whether or not a combustion operation start command has been inputted (S2), and if the result of this judgment is No, then it is determined whether or not some other command has been inputted (S3), and if there has been input of another command then control is executed corresponding to that other command (S4), and then the flow of control returns to S1.

If the result of the judgment in S2 is Yes, then in S5 it is determined whether or not the setting of the dip switch 16*a* for indicating that the check valve 12 is connected is ON, and if the result of this judgment is No, then the flow of control is transferred to S8, whereas if the result of this S5 judgment is Yes, then in S6 it is determined whether or not there is another combustion device 2 that is currently performing combustion operation, and if the result of this judgment is Yes then the flow of control is transferred to S8, whereas if the result of the judgment in S6 is No then the flow of control is transferred to S7.

In S7, the driving of the blower fan 9 is controlled so as to execute air purge according to slow-start air purge. The slow-start air purge in this case may be performed according to the slow-start air purge of the first pattern shown in FIG. 3, or may be performed according to the slow-start air purge of the second pattern shown in FIG. 4; but the slow-start air purge of the second pattern is preferred.

If the combustion device 2 is being used singly by itself, then, since the dip switch 16*a* is not set to its ON position that specifies connection of the check valve 12, accordingly the result of the judgment in S5 is No, and in S8 operation of the blower fan 9 is controlled to perform air purge according to the normal pattern. Furthermore, even the dip switch 16*a* is set to its ON position so as to specify connection of the check valve 12, if there is another combustion device 2 that is performing combustion operation, then the judgment in S6 becomes Yes, and in S8 air purge according to the normal pattern is performed.

This is because, if there is another combustion device 2 that is performing combustion operation, since its combustion exhaust is flowing into the common exhaust duct 4 and accordingly the internal pressure within the duct 4 is high, therefore even if air purge starts from the not-yet-burning state, the valve plate 26 of the check valve 12 still does not rise sharply, and the noise when it collides with the stopper 28 does not become high.

If, in the determination of S9 after S7 and S8, it is determined that the predetermined air blowing amount has been reached, then S9 is repeated while the result of this judgment remains No, and when the result of the S9 judgment becomes Yes, in S10, a judgment is made as to whether or not a predetermined time interval (for example one second) has elapsed, and if the result of this judgment is No then S10 is repeated, whereas when the result of this judgment becomes Yes, in S11, combustion operation is started by igniting the burner 8, and then the flow of control returns.

The operation and the beneficial effects of the combustion devices 2 explained above will now be explained in the following.

Since the exhaust ports of the plurality of combustion devices 2 are connected to the common exhaust duct 4, and the check valves 12 are disposed between the common exhaust duct 4 and the exhaust ports 3, accordingly, during the combusting state of one of the combustion devices 2, its combustion exhaust can be discharged to the common exhaust duct 4 via its check valve 12, while, during the non-combusting state of one of the combustion devices 2, back flow of combustion exhaust into that combustion device from the common exhaust duct 4 can be prevented with its check valve 12.

When a check valve 12 is connected to the exhaust port 3 as described above, and the setting specifying that the check valve 12 is connected has been established with the dip switch 16*a*, then, in the air purge, the operation of the blower fan 9 is controlled by performing slow-start air purge in which the time interval from the time point when the air purge starts until the time point when a predetermined air blowing amount is reached becomes longer than it would be if no check valve 12 were connected, so that sharp rising of the valve plate 26 of the check valve 12 is suppressed because the amount of air blown from the blower fan 9 becomes small, and therefore the collision noise when the valve plate 26 collides with the stopper 28 is eliminated or alleviated.

When the first pattern for the slow-start air purge is adopted, then the rate of increase of the fan rotational speed is low, and, since the rate of increase of the air blowing amount is low, abrupt rising of the check valve 12 is suppressed, so that it is possible to cancel or alleviate the noise of collision between the valve plate 26 of the check valve 12 and the stopper 28.

On the other hand, when the second pattern for the slow-start air purge is adopted, then the operation of the blower fan 9 is controlled so that, after the air blowing amount has been progressively increased from zero up to an intermediate air blowing amount at which there is no risk of the valve plate 26 of the check valve 12 coming into contact with the stopper 28, and after having then waited for the predetermined interval at this air blowing amount at which the check valve 12 has already partially opened but is not yet fully opened, the air blowing amount is then progressively increased again until the predetermined air blowing amount is reached. Since the system waits for the predetermined time interval at the intermediate air blowing amount at which the check valve 12 is partially open, accordingly abrupt rising of the check valve 12 is suppressed, so that it is possible to cancel or alleviate the noise of collision between the valve plate 26 and the stopper 28.

However, when some other combustion device 2 is performing combustion operation, normal air purge is performed. This is because, since that combustion exhaust is flowing in the common exhaust duct 4 and the internal pressure within the duct is high, accordingly, even if normal air purge is performed from the not-yet-burning state, the valve plate 26 of the check valve 12 does not rise abruptly, and the noise of collision when the valve plate 26 comes into contact with the stopper 28 is not severe.

Next, examples in which the above embodiment is partially changed will be explained.

1) The number of combustion devices 2 that are installed to the compound combustion system 1 is not to be considered as being limited to three; it would also be acceptable for there to be four or more. The combustion devices 2 shown in FIG. 1 are only examples, and are not to be considered as being limitative.

2) It would also be possible for a person skilled in the art to implement the present invention in a way with various modifications added to the embodiment described above, without departing from the spirit of the present invention, and the present invention is to be understood as including modifications of that sort.

The invention claimed is:

1. A combustion device, comprising:

a combustion unit;

an ignition means;

a fuel supply unit for supplying fuel to the combustion unit;

a blower unit for supplying air for combustion;

an exhaust port that discharges combustion exhaust;

a control means that, before ignition of fuel supplied to the combustion unit by operation of the ignition means, performs air purge of the combustion unit at a predetermined air blowing amount by driving the blower unit; and a setting means for setting to indicate that a check valve for preventing back flow of exhaust is connected to the exhaust port;

wherein, when the setting means is set to indicate that the check valve is connected, the control means controls an operation of the blower unit so that slow-start air purge is performed in which a time interval from a start of air purge until the predetermined air blowing amount is reached becomes longer, than in a case in which no such check valve is connected.

2. The combustion device according to claim 1, wherein, in the slow-start air purge, an operation of the blower unit is controlled so that, after having waited for a predetermined time interval at an intermediate air blowing amount at which the check valve is partly open, air blowing amount is increased until it reaches the predetermined air blowing amount.

3. A combustion system, comprising a plurality of combustion devices, each of which comprises:

a combustion unit;

an ignition means;

a fuel supply unit for supplying fuel to the combustion unit;

a blower unit for supplying air for combustion;

an exhaust port that discharges combustion exhaust;

a control means that, before ignition of fuel supplied to the combustion unit by operation of the ignition means, performs air purge of the combustion unit at a predetermined air blowing amount by driving the blower unit; and a setting means for setting to indicate that a check valve for preventing back flow of exhaust is connected to the exhaust port;

wherein, when the setting means is set to indicate that the check valve is connected, the control means controls an operation of the blower unit so that slow-start air purge is performed in which a time interval from a start of air purge until the predetermined air blowing amount is reached becomes longer, than in a case in which no such check valve is connected, and respective exhaust ports of the plurality of combustion devices are connected to a common exhaust duct, and respective check valves are disposed between the common exhaust duct and respective exhaust ports.

4. The combustion system according to claim 3, wherein, in the slow-start air purge, an operation of the blower unit is controlled so that, after having waited for a predetermined time interval at an intermediate air blowing amount at which the check valve is partly open, air blowing amount is increased until it reaches the predetermined air blowing amount.

5. The combustion system according to claim 3, wherein, when combustion operation of one of the plurality of combustion devices is newly started while another one of the plurality of combustion devices is performing combustion, then the slow-start air purge is not performed.

* * * * *